United States Patent [19]

Keidser

[11] Patent Number: 5,070,561

[45] Date of Patent: Dec. 10, 1991

[54] BED CLOTHES

[76] Inventor: Jean M. Keidser, 6300 Rutsatz Rd., Deming, Wash. 98244

[21] Appl. No.: 581,116

[22] Filed: Sep. 11, 1990

[51] Int. Cl.[5] ..... A47G 9/00

[52] U.S. Cl. ..... 5/482; 5/486; 5/502

[58] Field of Search ..... 5/482, 485, 486, 488, 5/494, 502

[56] References Cited

U.S. PATENT DOCUMENTS

| | | | |
|---|---|---|---|
| 1,425,952 | 8/1922 | Fidler . | |
| 2,248,768 | 7/1941 | Licht . | |
| 2,637,860 | 5/1953 | Lehigh . | |
| 2,799,870 | 7/1957 | Sullivan . | |
| 3,137,871 | 6/1964 | Florio . | |
| 3,340,549 | 9/1967 | Billerbeck | 5/502 |
| 3,355,748 | 12/1967 | Tuvert . | |
| 3,381,321 | 5/1968 | Di Addario | 5/485 |
| 3,654,646 | 4/1972 | McMahon, Jr. | 5/485 X |
| 3,851,346 | 12/1974 | Fillmore | 5/485 |
| 3,965,504 | 6/1976 | Ainsworth . | |
| 4,316,299 | 2/1982 | Friedman | 5/485 |
| 4,339,835 | 7/1982 | Jaffe et al. | 5/485 X |
| 4,802,250 | 2/1989 | Farr | 5/488 X |
| 4,815,156 | 3/1989 | Williams | 5/485 |
| 4,903,361 | 2/1990 | Tang | 5/502 |

FOREIGN PATENT DOCUMENTS

| | | | |
|---|---|---|---|
| 906937 | 9/1962 | United Kingdom | 5/502 |
| 2079596 | 1/1982 | United Kingdom . | |

*Primary Examiner*—Michael F. Trettel
*Attorney, Agent, or Firm*—Hughes & Multer

[57] ABSTRACT

Bed covers which replace conventional sheets, spreads, comforters and the like and include a sheetlike component detachably fixed to a coverlet component as by Velcro or other fasteners or by buttons. A pocket for a blanket can be provided so that the same covering can be used in both warmer and cooler weather. Indicia for locating the cover relative to the four corners of a bed are provided as is a transversely extending fold line which is employed in making up a bed with pillows.

7 Claims, 5 Drawing Sheets

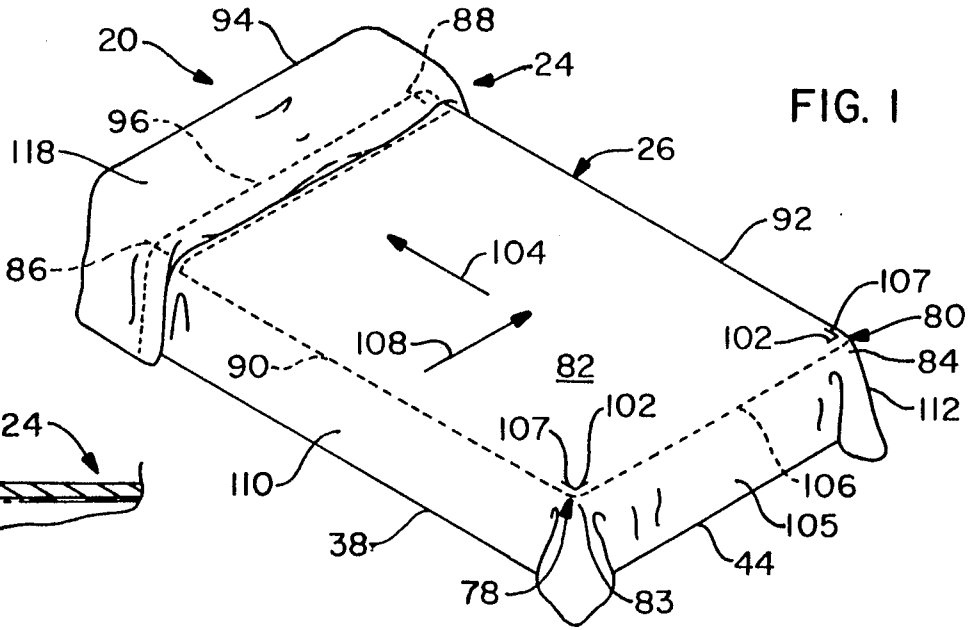
FIG. 1
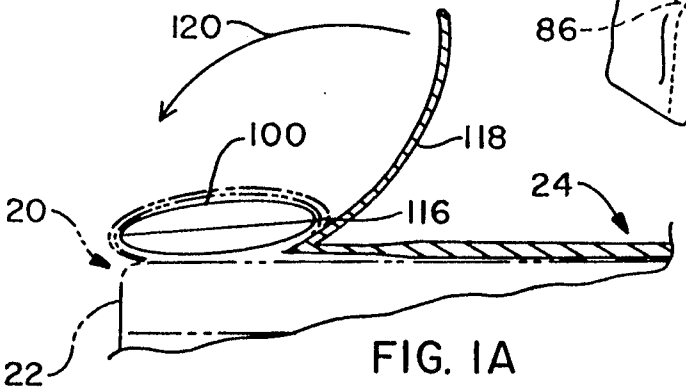
FIG. 1A
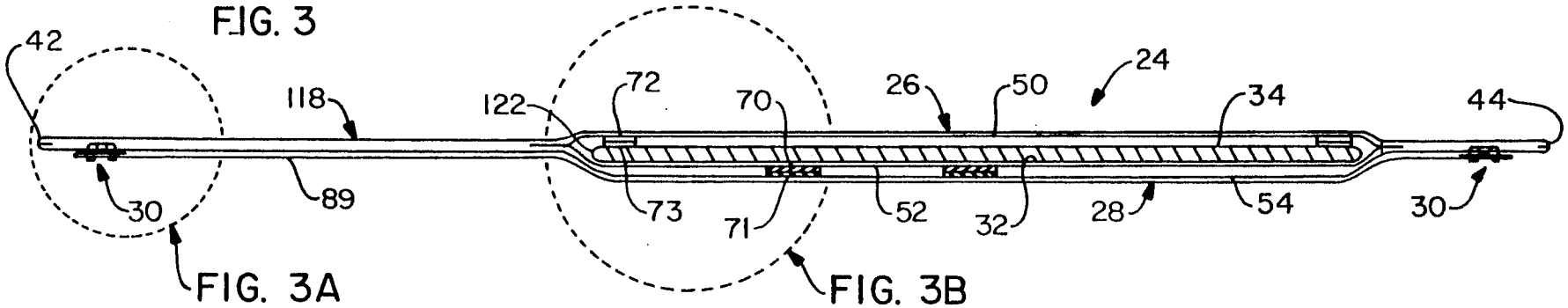
FIG. 3
FIG. 3B
FIG. 3A

BED CLOTHES

TECHNICAL FIELD OF THE INVENTION

The present invention relates to bed coverings and, more specifically, to novel, improved bed coverings which facilitate the making of a bed, minimize the entanglement of bed clothing by restless sleepers, and can be employed to keep a user comfortable over a wide range of temperatures.

BACKGROUND OF THE INVENTION

Making a bed is relatively time-consuming and, to many, a tedious, unpleasant task. Furthermore, bed making is labor intensive and therefore costly in hotel, motel, hospital and other operations in which large numbers of beds have to be made on a frequent, if not daily, basis.

In an effort to simplify and speed the bed making process, it has been proposed that conventional bed clothes such as top sheets and spreads be assembled together so that the making of a bed involves only the handling of a single assembly. Such proposals are found in U.S. Pat. No. 3,355,748 issued Dec. 5, 1967 to Tuvert and in British patent application No. 2079596 filed by Falces and published Jan. 27, 1982.

These prior proposals are not entirely satisfactory. Considerable time can be expended simply in properly locating a bed clothing assembly on a bed being made up. The assembly must parallel the edges of the bed, have marginal portions of equal width draped over the sides of the bed, and have a marginal portion of relatively precise length draped over the foot of the bed. The Falces and Tuvert bed closing assemblies do not aid one in thus orienting them on the bed being made up.

In making up a bed, the top spread or coverlet is commonly turned down at the head of the bed. Pillows are then placed at the head of the bed with their lower edges overlying the folded down bed clothes. The bed making process is completed by pulling or folding the top marginal portion of the coverlet up and over the pillows to cover them. This requires a rather precise turning down of the spread or coverlet so that the top edges of the pillows will not be exposed when the coverlet is thereafter turned up fold too high) or, alternatively, so that there will not be unsightly excess material at the top of the bed (fold too low). To properly locate this fold line for the pillows may require more than one try. This is frustrating and time consuming and is another problem not addressed by either Tuvert or Falces.

A blanket is commonly added to bed clothes to keep the occupants of a bed comfortable at lower temperatures. Ideally, then, a bed clothes assembly should make provision for conveniently adding a blanket to it so that the same assembly can be employed over a wide temperature range. Of those items of prior art cited above, only Falces addresses this problem. However, his solution utilizes a somewhat complicated arrangement of multiple pockets and multiple zippers that would be relatively costly to provide and cumbersome to employ.

SUMMARY OF THE INVENTION

I have now invented, and disclosed herein, novel bed clothes assemblies which, like those proposed by Tuvert and Falces, are designed to simplify and otherwise speed the bed making process. However, my novel bed clothes assemblies have a number of important features which minimize and eliminate the drawbacks of those heretofore proposed assemblies, even further, and significantly, speeding and simplifying the bed making process.

My novel bedcovers have a spread, comforter, or other coverlet to which a top sheet is buttoned or otherwise detachably fixed—for example, by hook-and-filament type fasteners or snaps—to facilitate the making of a bed while allowing the sheet to be detached and separately washed. A pocket in the spread accommodates a blanket for extra warmth. Indica or locators toward the lower end of the bedcover allow it to be rapidly positioned on the bed being made, and there is a transverse index or fold line toward the upper end of the cover. The cover is folded down along this line, the pillows placed on the bed being made, and the cover then folded back up over the pillows to complete the bed making process. Closures at the open end of the pocket and cooperating, typically hook-and-filament fasteners located in the pocket and on the blanket keep the blanket from shifting relative to the spread and top sheet components of the assembly.

Because only a single bedcover has to be handled, the present invention significantly facilitates the making of beds. This desirable objective is further promoted by the present invention, as is the neatness of the made up bed, because the locating indicia allow one to easily, rapidly, and properly position the bedcover on the bed being made. In addition, the transverse index line makes it much easier and faster to complete the bed making process when pillows are involved, thus even further facilitating the making of beds. At the same time, the components of the bedcover are easily assembled and also easily disassembled so that they can be individually cleaned as they become soiled and replaced as they wear out or are to be changed for other reasons.

The novel bedcovers disclosed herein also have the advantage that they eliminate the entanglement of bed clothes which commonly occurs when a bed is occupied by a restless sleeper. Consequently, a bed made up in accord with the principles of the present invention is often more comfortable and relaxing to lie in.

The upper or outer component of my novel bed covers, akin to a conventional bedspread, comforter, or other coverlet, can be fabricated from the same types of fabrics as conventional coverlets and in sizes to fit the beds for which conventional coverlets are intended; and the same is true of the bottom, "top sheet" component. This allows the novel bedcovers disclosed herein to be furnished with exposed, upper and lower panels having an endless variety of textures, colors, and patterns.

Another decided advantage of the present invention is that the bedcovers disclosed herein are relatively simple and the steps needed to fabricate them straightforward and few in number. They can be made without any parts that are not off-the-shelf components. Consequently, unless designer or other expensive fabrics are employed, those covers are comparatively simple and inexpensive to produce.

OBJECTS OF THE INVENTION

From the foregoing, it will be apparent to the reader that one important and primary object of the present invention resides in the provision of novel, improved bed clothes.

Other also important but more specific objects of the invention reside in the provision of bed clothes as described in the preceding object:

which significantly reduce the time required to make a bed and the tedium of this task which reduce the likelihood of the bed clothes being entangled by a restless sleeper:

which can be employed to keep a sleeper comfortable in both cooler weather and when temperatures are higher;

which are intended to replace conventional bedspreads and other exposed coverings and can, like the former, can be supplied in an endless variety of fabrics, patterns, and colors;

which have components that replace conventional sheets and can easily be replaced as they become soiled;

which are relatively inexpensive and easy to produce as well as easy to use.

Other important objects and features and additional advantages of the present invention will become apparent to the reader from the foregoing and the appended claims and as the ensuing detailed description and discussion proceeds in conjunction with the accompanying drawing.

BRIEF DESCRIPTION OF THE DRAWING

In the drawing:

FIG. 1 is a pictorial view of a bed made up with a bed cover embodying the principles of the present invention;

FIG. 1A is a fragmentary view showing the bed in the process of being made;

FIG. 3 is a section through the cover, taken substantially along line 3—3 of FIG. 2;

DETAILED DESCRIPTION OF THE INVENTION

Figure 2:
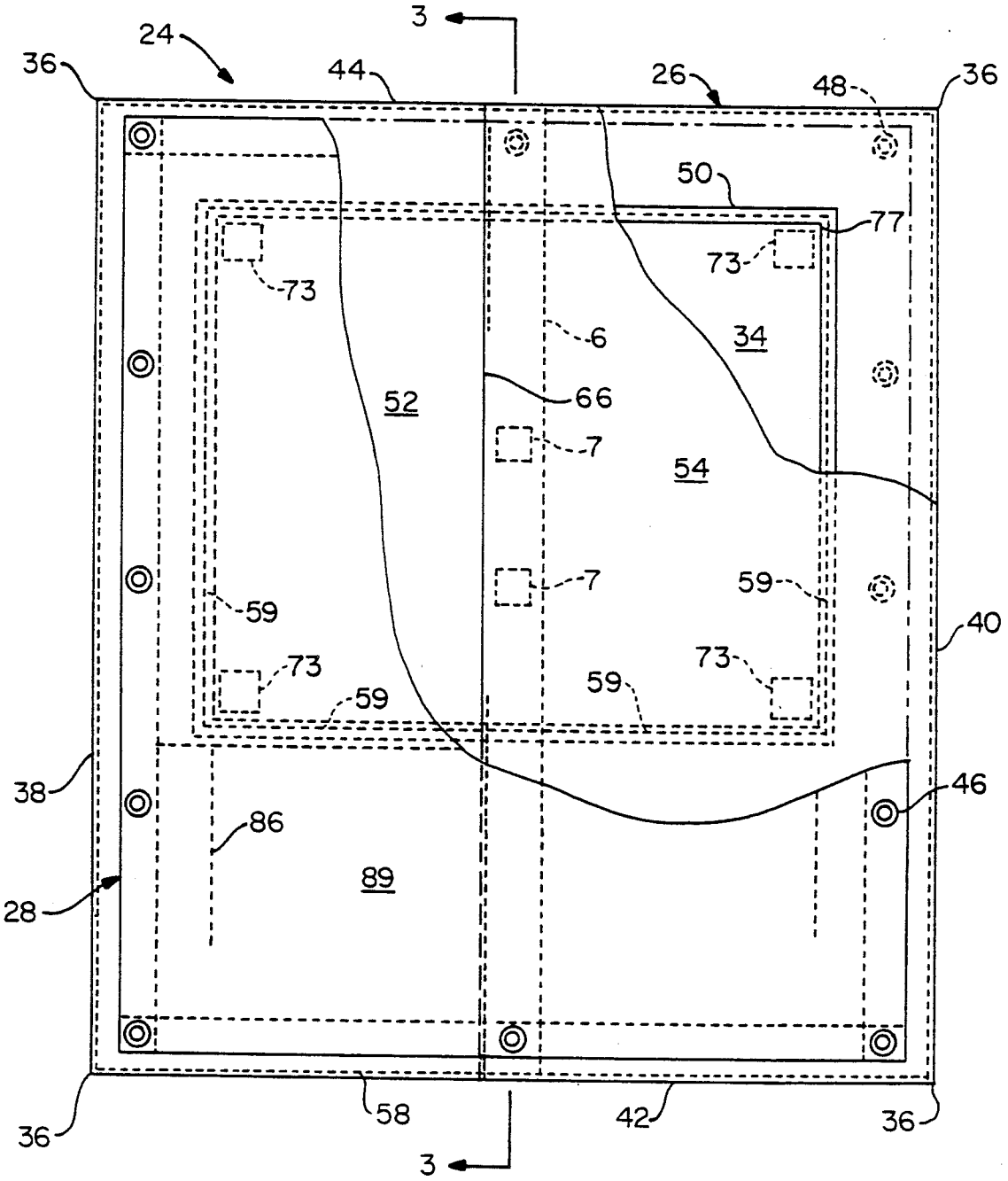
FIG. 2 is a plan view of the covering with certain of its components broken away to show other of the bed covering components.
Figure 3A:
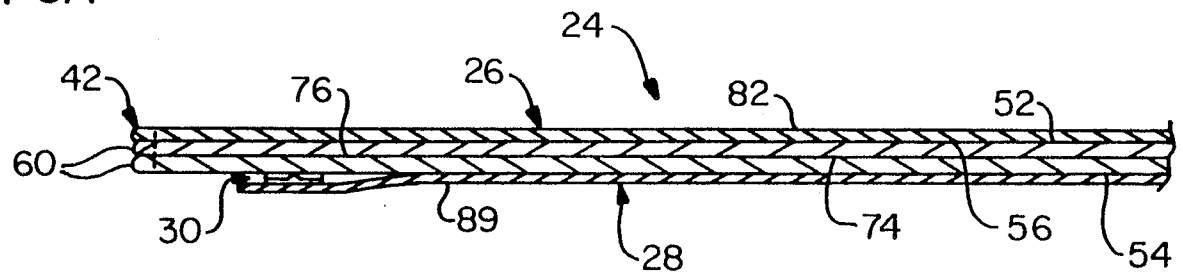
FIGS. 3A and 3B are fragments of FIG. 3 to an enlarged scale.
Figure 3B:
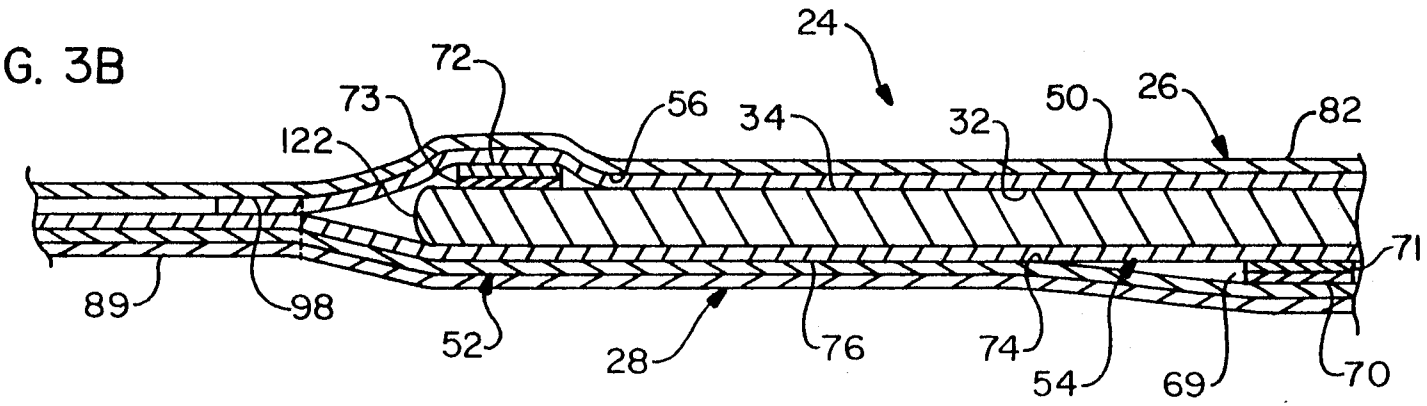

Referring now to the drawing, FIG. I depicts a bed 20 made up with only two items of bed clothes; viz., a fitted bottom sheet 22 and a bed cover 24 which embodies, and is constructed in accord with, the principles of the present invention.

Bed cover 24, best show in FIGS. 2, 3, 3A, 3B, and 4, includes: an upper or outer component 26 which is akin to the comforter, spread, etc. of conventional bedclothes and a bottom or inner component 28 which is akin to a conventional top sheet. Bottom component 28 is detachably fixed to top component 26 as by buttons, the illustrated snaps 30, or other fasteners. Also, bed cover 24 has a pocket S2 in which a blanket 34 can be removably installed for extra warmth.

Outer cover 26 may differ considerably in terms of appearance and the materials from which it is made. It may be a single piece of fabric with a loose leave or knit like a conventional bedspread; or it may have inner and outer panels separated by stuffing and then quilted together like a conventional quilt or comforter. This versatility allows an almost endless variety of fabrics, colors, and patterns to be employed.

Similarly, inner bed cower component 28 may be fabricated in a wide range of colors and patterns and from such conventional bedsheet materials as percale, flannel, satin, and linen. Or it may be a second coverlet; for example, one like the coverlet 26 with which it is used.

Figure 4:
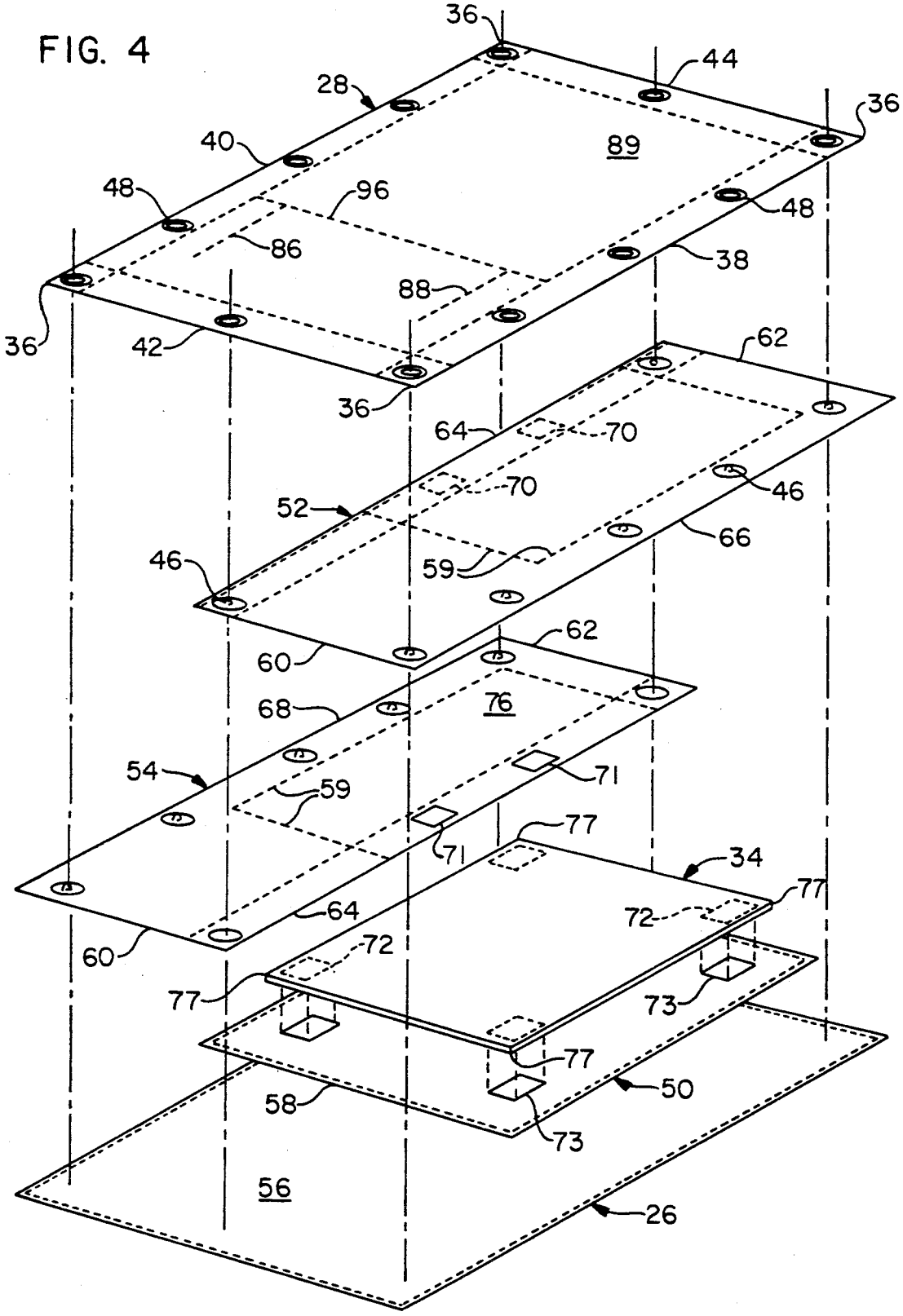
FIG. 4 s an exploded view of the cover.

As is best shown in FIGS. 2 and 4, the snaps 30 which hold the bottom and top bed cover components 28 and 26 together are located at the four corners 36 of bed cover 24, at equal intervals along the sides 38 and 40 of bed cover 24, and midway between those sides at the top 42 and the bottom 44 of the cover. The male components 46 of the fasteners can be attached to the bottom, top sheet emulating component 28 of bed cover 24 and the cooperating female components 48 to the top, exposed component 26; or this arrangement may be reversed. In either event the bottom component 28 is easily and readily attached to the top component 26 and equally easily separated from the latter so that the two bed cover components can be separately washed, for example.

If an alternate type f fastener such as buttons is employed instead of the illustrated snap-type fasteners 30, they would typically be placed at the same locations as fasteners 30. The buttons would preferably be sewn to the upper bed cover member 26 and the associated buttonholes worked in the bottom, top sheet replacing component 28.

The pocket 82 for the blanket or quilt 34 added to bed cover 24 when temperatures are cooler is made up of a top panel 50 and two associated bottom panels 52 and 54. Top panel 50 is sewn or otherwise fixed around its periphery to the bottom or inner side 56 of upper bed cover component 26. An exemplary row of stitching employed for this purpose is identified by reference character 58 in FIGS. 2 and 4 Rows of stitching through the top panel 50 and the two bottom panels 52 and 54 and identified by reference character 59 define the top and side boundaries of pocket 32.

The associated, bottom pocket panels 52 and 54 are also stitched at their top bottom and outer edges 60, 62, and 64 to the top bed cover component 26 with the inner edges 66 and 68 of components 52 and 54 overlapped and stitched to top cover component 26 at only the upper and lower margins 60 and 62 of the panels. This allows the inner edges 66 and 68 of lower pocket panels 52 and 54 to be pulled apart forming an opening 69 (see FIG. 3) through which blanket 34 can be slipped into pocket 32. Once this is accomplished, the inner edges of the two, pocket bottom panels 52 and 54 are, preferably, detachably secured together, and blanket 34 is detachably fixed to top pocket panel 50 to hold blanket 84 in place.

In that embodiment of the invention illustrated in FIGS 1–4, cooperating sets of facing Velcro or other hook-and-loop patches 70/71 and 72/73 are employed for this purpose. Patches 70 are sewn or otherwise attached to bottom pocket panel 52 along the inner edge 66 and on the top side 74 of that panel. Patches 71 are similarly attached, opposite patches 70, to the bottom side 76 and at the inner edge 68 of lower pocket panel 54. Patches 72 are attached to pocket top panel 50 and cooperating patches 73 are fixed in facing relationship to those patches at the corners 77 of blanket 84.

Referring now primarily to FIGS. 1, 1A, and 2, L-shaped indices or locators 78 and 80 are provided on the top or exposed surface 82 of bed cover upper component 26 at locations corresponding to the two bottom corners 83 and 84 of the bed with which the bed cover is to be employed—for example, the illustrated bed 20. Associated head-to-foot or longitudinally extending indexes or locators 86 and 88 are provided on the bottom side 89 of bed cover upper component 26 at locations corresponding to the two sides 90 and 92 of bed 20 and toward the head 94 of the bed. And, a transversely extending fold line or index 96 is provided on the bottom side 98 of bed cover lower component 26 at that location toward the head 94 of bed 20 where bed cover 24 is turned down to receive the usual pillows (one of these is shown in FIG. 1A and identified by reference character 100).

The just described locators materially facilitate the making of a bed. Specifically, the transversely extending legs 102 of L-shaped locators 78 and 80 allow one to quickly and effortlessly position bed cover 24 on bed 20 in the head-to-foot direction indicated by arrow 104 in FIG. 1 with the proper margin 105 draped over the foot 106 of the bed. Similarly, those legs 107 of locators 78 and 80 extending in the direction of arrow 104 allow one to easily position bed cover 24 in the transverse direction indicated by arrow 108 so that the overhanging margins 110 and 112 at the two sides of bed 20 are equal.

The locators 86 and 88 toward the head 94 of bed 20 similarly permit one to easily and rapidly align coverlet 24 at the head 94 of bed 20 in the transverse, arrow 108 direction so that the overhangs 110 and 112 are even or uniform from the foot 106 to the head 94 of bed 20.

Once bed cover 4 has been positioned on bed 20 in the effortless manner just discussed, the cover is turned down so that the pillows may be put in place. Again, this is a step which can be performed without effort and rapidly because the person making up bed 20 need not judge where to fold the cover down or check to ensure that the coverlet is folded down along a line parallel to the head 94 of bed 20. Instead, all that person need do to properly locate the fold is to simply turn to cover down along transversely extending locator or fold line 96. Then, pillows 100 are placed at the head 94 of bed 20 with their lower edges 116 lapping onto the folded down cover 24 as shown in FIG. 1A. Finally, the upper marginal section 118 of the coverlet is folded up and over the pillows as shown by arrow 120 in FIG IA to complete the bed making process.

In conjunction with the foregoing, it can be appreciated from FIGS. 1A and 3 that the top or upper edge 122 of blanket 34 lies toward the foot 106 of bed 20 from fold line 96. This considerably reduces the bulk of the upper marginal portion 118 of bed cover 24. That facilitates the steps of folding back that marginal portion along the fold line 96 and the subsequent step of folding marginal portion 118 up and over pillows 100 by reducing the bulk of the bed cover 24 at the head 94 of bed 20. This reduction in bulk also results in the made up bed 20 having a much neater appearance.

Locators 78, 80, 86, 88, and 96 can be provided in any desired manner. In that embodiment of the invention illustrated in FIGS. 1–4 and identified by reference character 26, they are simply lines of stitching in bed cover upper and lower components 26 and 28.

Figure 5:
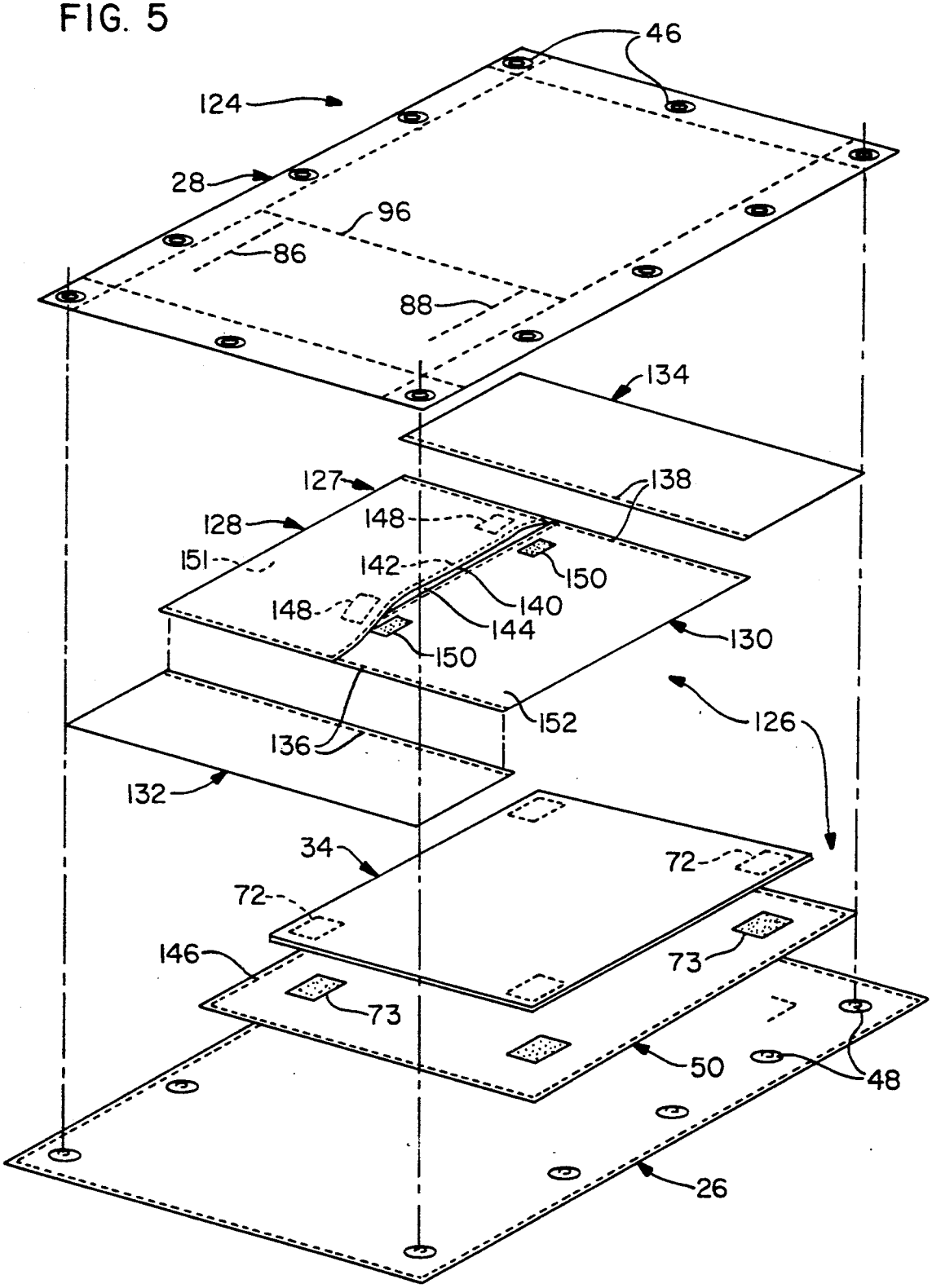
FIG. 5 is a view, similar to FIG. 4, of a second embodiment of the invention.

Referring still to the drawing, FIG. 5 depicts a bed cover 124 which also embodies and is constructed in accord with the principles of the present invention. This cover differs from cover 24 in the manner in which the blanket receiving pocket 126 is constructed. Although they do not have to be, covers 24 and 124 may otherwise be the same. Consequently, like reference characters have been employed to identify like parts of the two covers.

Pocket 126 has a top panel 50 stitched or otherwise fastened around its periphery to bed cover upper component 26 in the location and in the manner discussed above.

Associated with this panel is a lower or bottom pocket component 127 made up of two overlapping center panels 128 and 180, a head end panel 102, and a foot nd panel 184. Panels 132 and 134 are assembled to the overlapped central panels 128 and 130 as by the rows of stitching identified with reference characters 136 and 138.

In this case, the overlapping inner edges 140 and 142 of central panels 128 and 130 define a blanket receiving opening 144 which faces one side 92 of bed 20 rather than the head 94 of the bed as is the case with above-discussed pocket 32.

The assembled bottom component 127 of pocket 126 is sewn or otherwise attached around its periphery with top panel 50 of the pocket to bed cover top component 26. A line of stitching extending around component 127 and panel 50 and employed for this purpose is identified by reference character 146.

As is the case with pocket 32, provision is made for closing the opening 144 of pocket 126 and for keeping a blanket 34 installed in that pocket in place. The arrangement employed for these purposes in coverlet 124 includes Velcro or comparable patches 148/150 and 72/73. Patches 148 are sewn or otherwise attached to the top side 151 of panel 128 near the inner margin 140 of that panel. The cooperating Velcro patches 150 are similarly attached in facing relationship to patches 148 to the bottom side 152 of panel 130 near the inner margin 142 of that panel.

The invention may be embodied in forms other than that disclosed above without departing from the spirit or essential characteristics of the invention. The present embodiment is therefore to be considered in all respects as illustrative and not restrictive, the scope of the invention being indicated by the appended claims rather than by the foregoing description; and all changes Which come within the meaning and range of equivalency of the claims are therefore intended to be embraced therein.

What is claimed is:

1. A bed covering which comprises:

a first, coverlet component with an exposed, visible surface;

a second, sheetlike component which is adapted to cover a person on a bed made up with the covering;

means detachably fixing the second component in face-to-face relationship to the first component with one surface of the first, coverlet component exposed; and means providing a pocket between the first and second components for a third, blanketlike component which can be removably inserted to increase the warmth afforded by the covering;

the means providing said pocket comprising: a first panel with upper, foot, and side edges, said panel being assembled to said coverlet component, and second and third panels which also have upper, foot and side edges and are narrower in width than said first panel, said second and third panels being assembled in side-by-side relationship to said first panel: (a) along the upper, foot, and side edges of the first panel, and (b) with the apposite side edges of the second and third panels overlapped and free to move relative to each other to provide an opening through which said third component can be inserted into said pocket.

2. A bed covering as defined in claim 1 wherein the top edge of the blanket receiving pocket lies short of an upper end of the covering, whereby: any blanket in that pocket will similarly lie short of that upper end, an upper marginal portion of the covering will be relatively free of bulk, and said upper marginal portion will therefore be easy to turn down and then fold up on a pillow.

3. A bed covering as defined in claim 1 which comprises means for sealing said pocket after a blanket has been inserted.

4. A bed covering as defined in claim 1 which has means for detachably fixing an inserted blanket to the inside of the pocket to keep the blanket from shifting.

5. A bed covering as defined in claim 1 in which the means for detachably fastening the second component of the covering to the first component are buttons or snap-type fasteners.

6. A bed covering as defined in claim 1:

which has indicia means for locating said covering component on said bed in a specified relationship to the head, foot, and sides of the bed;

said indicia means being located on the exposed surface of said coverlet component and only on that component and: (a) toward a side edge of the covering and the foot edge thereof, and (b) toward a side edge of the covering and the top edge thereof; and the spacing between the side edges of the covering and the indicia respectively located at the foot edge and toward the top edge of the covering being the same.

7. A bed covering as defined in claim 6 which includes means defining a transversely extending line on the exposed surface of the coverlet component and only on that component along which said covering can be first folded down and then pulled up over and around a theretofore deposited pillow overlying the fold to cover said pillow.

* * * * *

UNITED STATES PATENT AND TRADEMARK OFFICE

CERTIFICATE OF CORRECTION

PATENT NO. : 5,070,561

DATED : December 10, 1991

INVENTOR(S) : Jean M. Keidser

It is certified that error appears in the above-indentified patent and that said Letters Patent is hereby corrected as shown below:

Column 1, line 46, before "fold" insert --parenthesis--.
Column 3, line 5, after "task" insert --semicolon--.
Column 3, line 7, change "colon" to --semicolon--.
Column 3, line 59, "S2" should be --32--.
Column 4, line 1, "cower" should be --cover--.
Column 4, line 22, "f" should be --of--.
Column 4, line 29, "82" should be --32--.
Column 4, line 36, after "4" insert --period--.
Column 4, line 41, "top bottom and" should be --top, bottom, and--.
Column 4, line 53, "84" should be --34--.
Column 4, line 55, after "FIGS" insert --period--.
Column 4, line 62, after "50" insert --comma--.
Column 4, line 64, "84." should be --34.--.
Column 5, line 31, "4" should be --24--.
Column 5, line 45, "FIG IA" should be --FIG. 1A--.
Column 6, line 10, "180" should be --130--; "102" should be --132--.
Column 6, line 11, "nd" should be --end -- ; "184" should be --134--.

Signed and Sealed this

First Day of March, 1994

Bruce Lehman

*Attest:*

BRUCE LEHMAN

*Attesting Officer*

*Commissioner of Patents and Trademarks*